United States Patent [19]

Zakrajsek

[11] Patent Number: 4,598,838

[45] Date of Patent: Jul. 8, 1986

[54] TRASH RECEPTACLE

[75] Inventor: Jerome A. Zakrajsek, Fredonia, Wis.

[73] Assignee: DCI Marketing, Milwaukee, Wis.

[21] Appl. No.: 692,397

[22] Filed: Jan. 18, 1985

[51] Int. Cl.[4] ..... B65D 25/16

[52] U.S. Cl. ..... 220/404; 220/1 T; 220/254

[58] Field of Search ..... 220/404, 403, 1 T, 254, 220/351, 356, 334

[56] References Cited

U.S. PATENT DOCUMENTS

| | | | |
|---|---|---|---|
| 1,227,463 | 5/1917 | Luyties | 220/254 X |
| 2,511,481 | 6/1950 | Schneider | 220/404 X |
| 2,748,673 | 6/1956 | Winstead | 220/404 X |
| 2,757,859 | 8/1956 | Holland | 220/254 X |
| 2,790,576 | 4/1957 | Lawrence | 220/356 |
| 3,749,274 | 7/1973 | Mele et al. | 220/254 X |
| 3,964,630 | 6/1976 | Getz | 220/1 T X |
| 4,105,412 | 8/1978 | Petzinger | 220/1 T X |
| 4,167,271 | 9/1979 | Jorgenson | 220/1 T X |
| 4,494,679 | 1/1985 | Cleevely | 220/254 X |

*Primary Examiner*—Steven M. Pollard

[57] ABSTRACT

A trash receptacle comprising a cylindrical container having a height and including a closed lower end, an open upper end, and an upper portion, and a cylindrical cover member having a height substantially less than the height of the container, the cover member including a generally closed upper end having therein a trash receiving opening, and an open lower end such that the cover member fits over the upper portion of the container.

5 Claims, 3 Drawing Figures

TRASH RECEPTACLE

BACKGROUND OF THE INVENTION

The invention relates to receptacles or containers for trash.

It is well known to place a conventional plastic garbage bag in a waste basket with the upper end of the garbage bag folded over the upper end of the waste basket. It is also well known that the garbage bag often slips off the upper end of the waste backet, thereby allowing trash or garbage to fall between the garbage bag and the interior of the waste basket and defeating the purpose of the garbage bag.

SUMMARY OF THE INVENTION

The invention provides a garbage or trash receptacle which can be used with a conventional garbage bag, with a conventional trash barrel, or by itself, and which, when used with a garbage bag, avoids the above described problem.

The trash receptacle of the invention comprises a cylindrical container including a closed lower end and an open upper end, and a cylindrical cover member which fits over the upper end of the cylindrical container. The cover member has a top wall having a trash receiving opening therein. Preferably, the cover member includes a lid pivotally mounted in the opening to allow placement of trash through the opening.

In the preferred embodiment, the container has an upper portion having an outside diameter, and a lower portion having an outside diameter greater than the outside diameter of the upper portion. The cover member has a height slightly less than the height of the upper portion of the container, and an outside diameter substantially equal to the outside diameter of the lower portion of the container. A shoulder extends circumferentially around the container at the junction between the upper and lower portions, and the cover member rests on the upper end of the container such that the lower end of the cover member is slightly spaced apart from the shoulder.

Preferably, the container is adapted to removably contain a conventional plastic garbage bag having its upper end folded over the upper end of the container. To avoid the problem of the garbage bag slipping off the upper end of the container, the outer surface of the container includes a plurality of ribs extending circumferentially around the outer surface of the upper portion of the container. When a garbage bag is placed in the container with its upper end folded over the upper end of the container, the cover member fits over the upper portion of the container such that the garbage bag is secured between the upper end of the container and the top wall of the cover member, and between the ribs on the container and the side wall of the cover member, and such that the cover member covers the portion of the garbage bag folded over the upper end of the container. Furthermore, because of a relatively tight fit between the cover member and the upper portion of the container, the portion of the garbage bag folded over the upper end of the container is actually urged further down over the upper end of the container when the cover member is placed on the container.

The trash receptacle can alternatively contain a conventional trash barrel instead of a plastic garbage bag, or it can be used without either a garbage bag or a trash barrel contained therein. In a further alternative use, the cover member alone can be placed over the top of a trash barrel.

Other features and advantages of the invention are set forth in the following detailed description, claims, and drawings.

Figure 1:
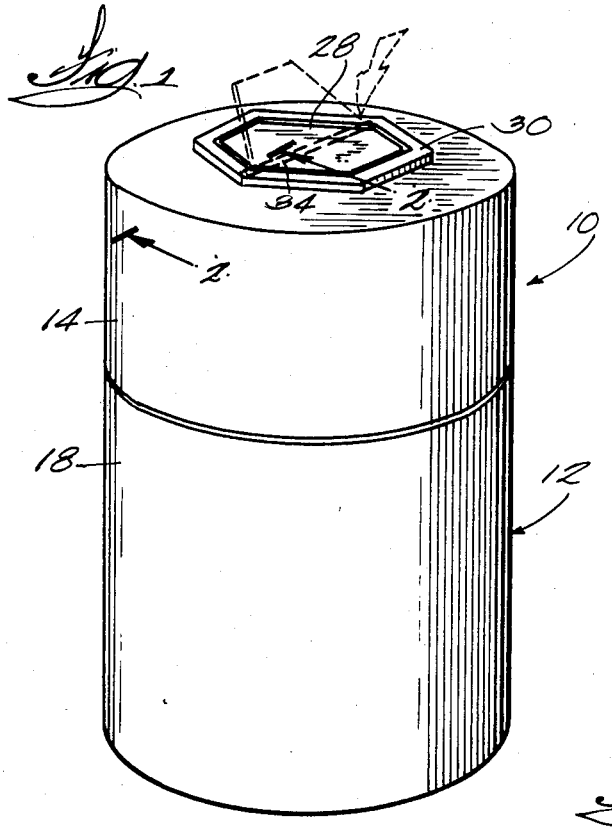
FIG. 1 is a perspective view of a trash receptacle embodying the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A trash receptacle 10 embodying the invention is illustrated in the drawings. The trash receptacle 10 comprises a cylindrical container 12 having a closed lower end and an open upper end, and a cylindrical cover member 14 which fits over the upper end of the cylindrical container 12.

The container 12 includes an upper portion 16 having an outside diameter, and a lower portion 18 having an outside diameter greater than the outside diameter of the upper portion 16. A shoulder 20 extends circumferentially around the container 12 at the junction between the upper and lower portions 16 and 18. A plurality of ribs 22 extend circumferentially around the upper end of the upper portion 16 of the container 12. The reason for the ribs 22 will be explained hereinafter.

The container 12 can hold a conventional plastic garbage bag 24, as shown in the drawings, or it can hold a conventional trash barrel (not shown). Also, the container 12 can receive trash directly.

The cover member 14 has a cylindrical side wall 25 and a flat top wall 27. The top wall 27 includes a trash receiving opening 26, and, in the preferred embodiment, the cover member 14 also includes a lid 28 pivotally mounted in the opening 26. In the illustrated construction, the opening 26 and the lid 28 are hexagonal, and the cover member 14 further includes a hexagonal frame member 30 mounted around the perimeter of the opening 26. The frame member 30 includes two opposing apertures 32 which receive the opposite ends of a pivot pin 34 on which the lid 28 is mounted. While the cover member 14 is primarily intended to be placed over the upper end of the container 12, it can also be placed directly over the upper end of a trash barrel, without the container 12.

The inside diameter of the side wall 25 of the cover member 14 is only slightly greater than the outside diameter of the upper portion 16 of the container 12 so that the cover member 14 fits snugly over the upper portion 16 of the container 12. The outside diameter of the cover member 14 is substantially equal to the outside diameter of the lower portion 18 of the container 12. The cover member 14 has a height slightly less than the height of the upper portion 16 of the container 12 so that when the cover member 14 is placed on the container 12 the top wall 27 of the cover member 14 rests on the upper edge of the upper portion 16 of the container 12, and the lower end of the cover member 14 is slightly spaced apart from the shoulder 20.

Figure 2:
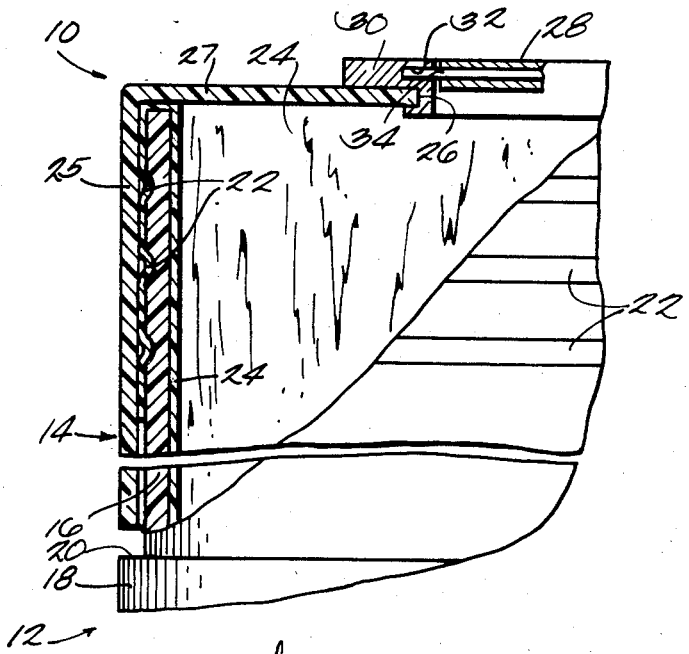
FIG. 2 is a fragmentary side view, partially cut away, of the trash receptacle containing a plastic garbage bag.
Figure 3:
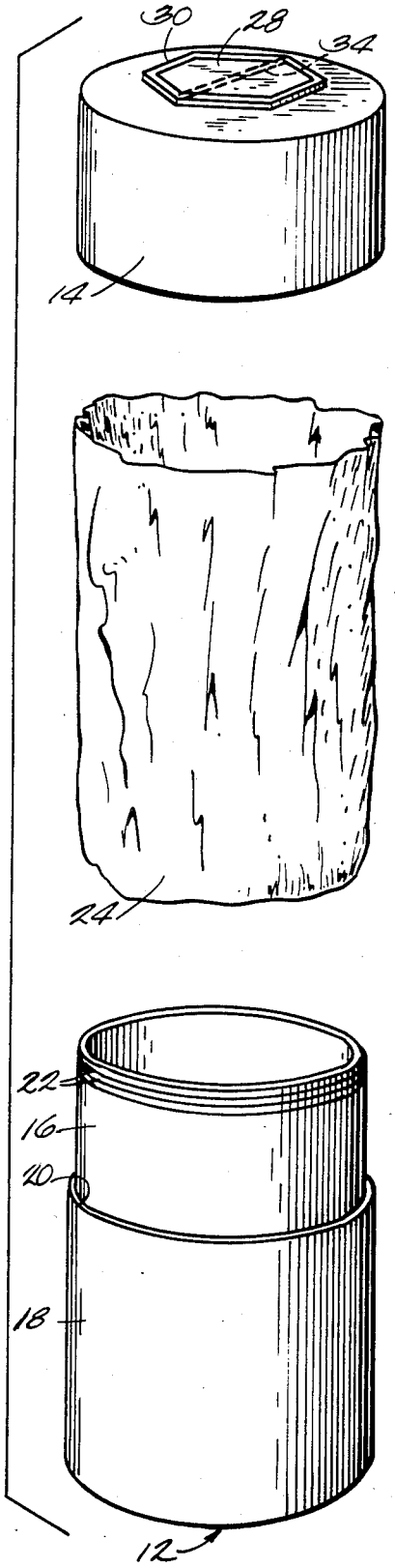
FIG. 3 shows the cover member and garbage bag removed from the container.

When the garbage bag 24 is placed in the container 12 with its upper end folded over the upper edge of the container 12, as shown in FIG. 2, the cover member 14 fits over the upper portion 16 of the container 12 such that the garbage bag 24 is secured between the upper edge of the container 12 and the top wall 27 of the cover member 14, and between the ribs 22 on the container 12 and the side wall 25 of the cover member 14. The ribs 22 help to secure the garbage bag 24 between the upper portion 16 of the container 12 and the side wall 25 of the cover member 14 and prevent the garbage bag 24 from slipping off the upper edge of the container 12. Furthermore, when the cover member 14 is placed over the container 12 with the garbage bag 24 folded over the upper edge of the container 12, the cover member 14 further secures the garbage bag 24 by exerting a downward force on the portion of the garbage bag 24 folded over the upper edge of the container 12. When in place, the cover member 14 covers the portion of the garbage bag 24 folded over the upper edge of the container 12.

Various other features of the invention are set forth in the following claims.

I claim:

1. A trash receptacle comprising a cylindrical container including a closed lower end, an open upper end, an upper portion having a height and an outside diameter, and a lower portion having an outside diameter greater than the outside diameter of said upper portion, said container having an outer surface and including a plurality of ribs extending circumferentially around said outer surface on said upper portion of said container, and said container removably containing a plastic garbage bag having its upper end folded over said upper end of said container, and a cylindrical cover member having a height less than the height of said upper portion of said container, and an outside diameter substantially equal to the outside diameter of said lower portion of said container, said cover member including a tubular side wall, a generally planar top wall perpendicular to said side wall and having therein a trash receiving opening, and an open lower end, said cover member fitting over and surrounding said upper portion of said container with said top wall of said cover member resting on said upper end of said container with said garbage bag secured between said upper end of said container and said top wall of said cover member and between said ribs and said side wall of said cover member, and with said cover member covering the portion of the garbage bag folded over the upper end of the container.

2. A trash receptacle as set forth in claim 1 wherein said cover member includes a lid mounted in said opening for pivotal movement about a generally horizontal axis.

3. A trash receptacle as set forth in claim 1 wherein said container includes a circumferentially extending shoulder at the junction between said upper portion and said lower portion, and wherein said cover member rests on said upper end of said container such that said lower end of said cover member is spaced apart from said shoulder.

4. A trash receptacle comprising a cylindrical container including a closed lower end, an open upper end, and an upper portion, said container having an outer surface and including a plurality of ribs extending circumferentially around said outer surface on said upper portion of said container, and a cylindrical cover member including a tubular side wall, a generally planar top wall perpendicular to said side wall and having therein a trash receiving opening, and an open lower end such that said cover member fits over said upper portion of said container, said container being adapted to contain a plastic garbage bag having its upper end folded over said upper end of said container, and said cover member fitting over said upper portion of said container such that the garbage bag is secured between said upper end of said container and said top wall of said cover member, and between said ribs and said side wall of said cover member, and such that said cover member covers the portion of the garbage bag folded over the upper end of the container.

5. A trash receptacle comprising a cylindrical container including a closed lower end, an open upper end, an upper portion, an outer surface, and a plurality of ribs extending circumferentially around said outer surface on said upper portion of said container, said container removably containing a plastic garbage bag having its upper end folded over said upper end of said container, and a cylindrical cover member including a generally closed upper end having therein a trash receiving opening, a tubular side wall, and an open lower end such that said cover member fits over and surrounds said upper portion of said container such that the garbage bag is secured between said ribs and said side wall of said cover member, and such that said cover member covers the portion of the garbage bag folded over the upper end of the container.

* * * * *